United States Patent [19]

Morrison

[11] 4,111,641

[45] Sep. 5, 1978

[54] INJECTION SYSTEM FOR FUEL COMBUSTION

[76] Inventor: Charles F. Morrison, 25 Pearl St., Malden, Mass. 02148

[21] Appl. No.: 771,718

[22] Filed: Feb. 24, 1977

Related U.S. Application Data

[63] Continuation-in-part of Ser. No. 664,967, Mar. 8, 1976, Pat. No. 4,009,984.

[51] Int. Cl.[2] ..... F23J 7/00

[52] U.S. Cl. ..... 431/4; 123/25 R; 261/18 A

[58] Field of Search ..... 43/3, 4, 190; 261/18 R, 261/18 A, 18 B; 123/25 R

[56] References Cited

U.S. PATENT DOCUMENTS

| | | | |
|---|---|---|---|
| 3,924,648 | 12/1975 | Etter | 431/4 |
| 4,009,984 | 3/1977 | Morrison | 431/4 |
| 4,014,637 | 3/1977 | Schena | 431/4 |

*Primary Examiner*—Edward G. Favors
*Attorney, Agent, or Firm*—Richard L. Stevens

[57] ABSTRACT

A vapor injector for use with a fuel combustion system which system has an air intake assembly and a combustion area. The vaporizer includes a platform floating on a reservoir of water. A vacuum chamber is defined by the platform and the surface of the reservoir. A perforated adjustable sleeve extends from the platform into the reservoir and determines the volume of the vacuum chamber. The volume of the chamber remains constant regardless of the level of the reservoir. The vaporizer is connected to the air intake assembly. A negative pressure is applied to the chamber and a saturated air stream flows from the chamber and into the combustion area.

15 Claims, 8 Drawing Figures

INJECTION SYSTEM FOR FUEL COMBUSTION

CROSS-REFERENCE TO RELATED APPLICATION

This application is a continuation-in-part application of my parent application U.S. application Ser. No. 664,967 filed Mar. 8, 1976 now U.S. Pat. No. 4,009,984.

BACKGROUND AND BRIEF SUMMARY OF THE INVENTION

In fossil fuel burners it is well known that the addition of water vapor enhances the combustion efficiency. Introduction of water vapor may be solely by positive pressure, U.S. Pat. No. 3,724,429; negative pressure (vacuum), U.S. Pat. No. 3,107,657; or both positive and negative pressure, U.S. Pat. No. 3,862,819. In this last-mentioned patent, the concept of water vapor introduced into a combustion chamber is applied to central heating units, such as oil heaters. This patent provides a fuel catalyzer which has a first conduit from the high pressure side of the fan associated with the oil burner to a position below a reservoir of water. A second conduit transports water vapor to the downstream side of the fan from a chamber above the reservoir.

The invention disclosed in U.S. Pat. No. 4,009,984 was directed to a system for regulating the metering of water vapor into the combustion area of a heating unit without altering the heating unit structurally. The invention employed only negative pressure (vacuum) and avoided fluctuation in the water level of a reservoir by utilizing a free floating platform which maintained a constant vapor chamber.

The invention comprised a vacuum-tight housing, a reservoir of water in the housing, and a constant vapor chamber disposed above the reservoir. A vacuum was created in the vapor chamber, which resulted in an airflow being drawn into the housing and through the reservoir. The airflow entrained metered amounts of highly vaporized water molecules which flowed into the vapor chamber and ultimately into the combustion chamber.

In the operation of that invention it was contemplated that for different-sized burners a valve would be sufficient to vary the amount of water vapor flowing into a combustion chamber. Practical experience has demonstrated that relying solely on the use of such a valve has not proven satisfactory, particularly because of the large variance in sizes of combustion chambers. Also it appeared that the use of a single flow passage for the introduction of air into the reservoirs was not always satisfactory, because of the non-uniformity of dispersion of air thorugh the reservoir and into the vacuum chamber.

The present invention is an improvement of the invention disclosed and claimed in U.S. Pat. No. 4,009,984. An apparatus and method are provided wherein the size of the vacuum chamber may be varied and uniform flow of air through the reservoir and into the vacuum chamber is achieved.

The invention comprises a tube adjustably secured to and depending from a free floating platform. The platform floats on a reservoir of water. The tube extends into the water and is characterized by a plurality of perforations. The perforations are immersed in the reservoir. Flow passages are formed externally of the tube whereby air is drawn through the flow passages, the water and ultimately into the vacuum chamber as a vapor stream.

In a preferred embodiment of the invention the tube is threaded into the platform and comprises an inner sleeve and an outer sleeve. A cover is secured to the upper edges of the sleeves. The sleeves define a flow passage. The inner sleeve below the water line is perforated. The portion of the cover lying between the inner and outer sleeves is apertured whereby when a vacuum is created in the vacuum chamber air flows in a uniform manner through the apertures, the water in the reservoir, the perforations of the inner sleeve and into the vacuum chamber.

DESCRIPTION OF THE PREFERRED EMBODIMENT

Figure 1:
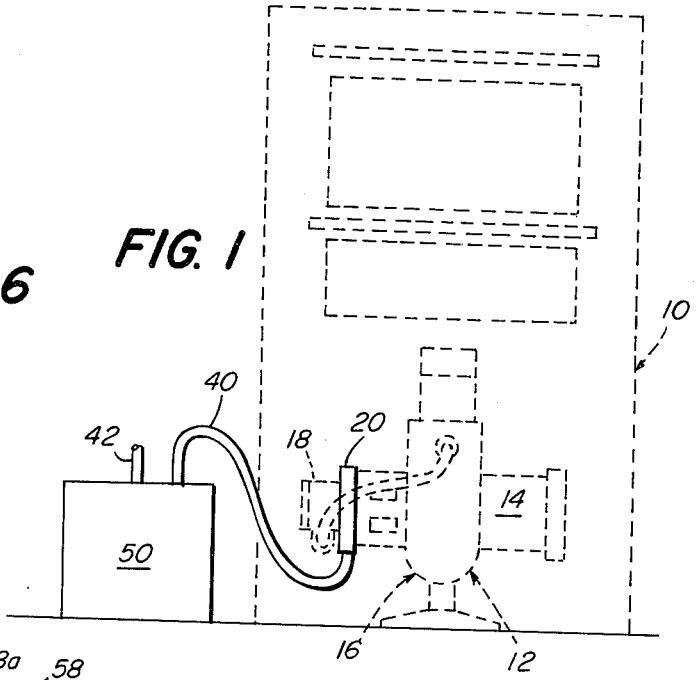
FIG. 1 is a front schematic view of a conventional oil burner in combination with an embodiment of the invention.

Referring to FIG. 1, a conventional furnace 10 and oil burner 12 are shown in dotted lines. The oil burner typically comprises a motor 14, a fan housing and air intake assembly 16 and an oil pump 18. A vapor injector 50 communicates with a vacuum fan 20 via conduit 40. A water inlet 42 is secured to the top of vapor injector 50.

Figure 2:
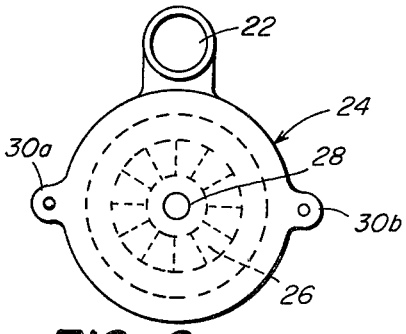
FIG. 2 is a front sectional view of a vacuum fan.

In FIG. 2, the vacuum fan 20 is shown and includes an air intake 22, a housing 24, a blade assembly 26 and shaft 28. For purposes of this invention, the fan is modified by securing lugs **30*a* and 30*b* to the housing. The vacuum fan 20 is conventional and is secured between the oil pump 18 and the fan housing and air intake assembly 16. Alternatively, it may be disposed between the assembly 16 and the motor 14**.

Figure 3:
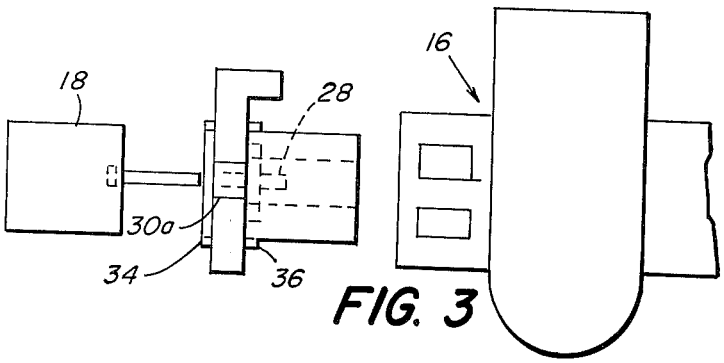
FIG. 3 is aside view of the fan of FIG. 2.

The oil pump 18 is removed and the fan 20 disposed between the pump 18 and the fan housing 16. In FIG. 3, the pump 18 is shown schematically. When assembled, the shaft 28 of the fan 20 is coupled to the shafts of the pump 18 and fan within the housing 16. The oil pump 18 on such burners is secured to the fan housing 16 by screws. When assembled, these screws pass through the lugs **30*a* and 30*b*. Seals 34 and 36 are disposed between the abutted surfaces of the fan 20 and pump 18, and the fan 20 and housing 18**. The coupling of the shafts may be accomplished in any suitable manner, such as pinning, splicing, etc.

Figure 4:
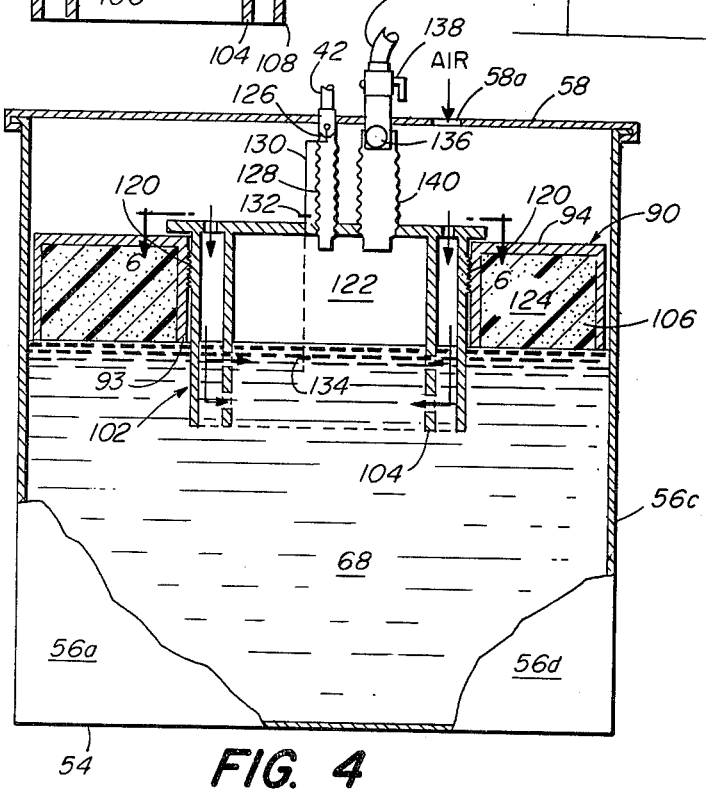
FIG. 4 is a front partially sectional view of a water injector embodying the invention.

Referring to FIG. 4, the vapor injector 50 is shown in greater detail and comprises a reactangular shaped housing 52 having a bottom plate 54 and front, side and back walls **56*a*, 56*b*, 56*c* and 56*d*. A top plate 58** is secured to the walls of the housing.

Figure 6:
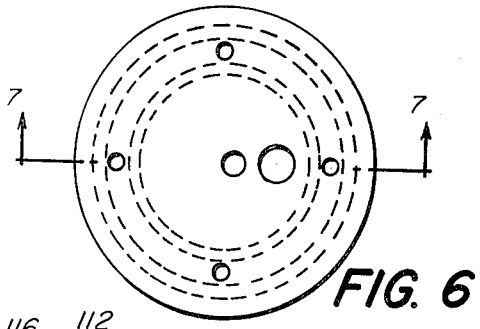
FIG. 6 is a plan view of the tube of FIG. 4 taken along lines 6—6.
Figure 7:
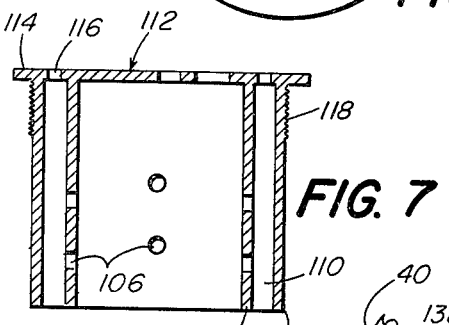
FIG. 7 is a front sectional view of the tube taken along lines 7—7 of FIG. 6; and, FIG. 8 is a schematic illustration of an alternative embodiment of the invention.

The housing 52 has a reservoir of water 68 which carries a free floating platform 90 having an outer depending wall 92 which is spaced apart from the inner surface of the walls **56*a*, 56*b*, 56*c* and 56*d*, an inner depending wall 93 and an upper plate 94. Secured to the upper plate 94 in a seal-tight manner is a tube 102. The tube 102 shown in greater detail in FIG. 7 comprises an inner sleeve 104 having perforations 106 and an outer sleeve 108. The sleeves define a flow passage 110 therebetween. Referring to FIGS. 4 and 6, a cover 112 is formed integrally with the upper edges of the sleeves 104 and 106, its periphery forming a lip 114 extending over the edge of the plate 94 of the platform 90. The portion of the cover 112 lying between the sleeves 104 and 106 is apertured at 116 to allow air into the flow passage 110**. The inner sleeve is open at its lower end but it may include an apertured bottom.

The upper outer surface of the sleeve 106 is threaded at 118. The inner surface of the wall 93 is threaded at 120. The inner surface of the sleeve 104, the surface of the water in the reservoir 68 and the lower surface of the upper plate 94 define a vacuum chamber 122. A foam-like material 124, such as close-celled polystyrene, is disposed between the depending walls 92 and has a planar lower surface which contacts the surface of the reservoir 68.

An automatic mechanically responsive off-on water valve 126 is secured to the plate 58. A flexible accordian-type conduit 128 connects the valve 126 to the plate 94. A rod 130 is secured to the valve 126 and passes through the platform 90 and not through the chamber 122. Upper and lower collars 132 and 134 are secured to the rod 130. The valve 126 is connected to a water supply line 42.

A pressure sensitive ball valve 136 in combination with a manual adjust valve 138 is secured to plate 58. A flexible accordian-type conduit 140 connects the valve 136 to plate 90.

The operation of the invention will be described in reference to the introduction of water vapor into a combustion area. However, it is to be understood that it may be used in any application wherein it is desired to meter particles into a fluid stream at a constant rate for any purpose.

In the operation of the invention, the platform 90 is disposed in the housing 52 and floats on the surface of the reservoir 68. If at any time the water in the reservoir 68 appreciably drops, the platform 90 will engage the collar 134, turning on the valve 126. Water will fill the reservoir until the platform engages the upper collar 132 shutting off the valve 126. The tube 102 is threaded into the plate 94, the lower portion of the tube 102 extending into the reservoir 68 as shown in FIG. 4. The burner requirements, i.e., a larger burner requires a larger vacuum chamber, will determine the extent to which the tube is immersed in the reservoir 68. Once the vacuum chamber size has been determined the juncture of the threads 118 and 120 may be sealed such as by soldering.

Figure 8:
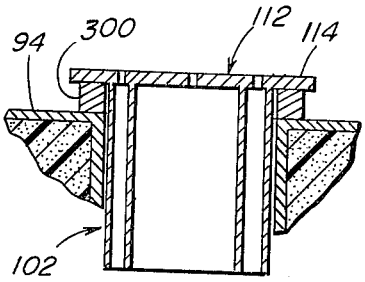

If desired, as shown in FIG. 8, the relationship among the tube 102, water level in the reservoir 68 and the platform 90 may be accomplished by inserting a ring collar 300 between the lip 114 of the cover 112 and the plate 94. Obviously collars 300 of different sizes may be used.

It is important to note that once the tube 102 has been secured at all times the relationship between the volume of the chamber 122 and the depth of the tube 102 entering the reservoir 68 is fixed. For any particular environment, the flow rate may be controlled by the valve 138. The cover 112 has been illustrated, FIG. 6 with four uniform equally-spaced perforations 116. The inner sleeve 104 has been illustrated with twelve uniform equally-spaced perforations 106. The perforations 116 and 106 may be of any size and arranged in any geometric configuration. The perforations 106 are arranged to ensure uniform flow of air both through the sleeve 104 and into the vapor chamber 122. This provides substantially uniform droplet size in the saturated air stream.

When the oil burner is actuated, the fan in the housing and the vacuum fan 20 both rotate. The vacuum fan 20 creates a negative pressure in the conduit 40. However, at this time, the valve 138 is closed. The flame in the combustion area is examined. Normally, the outer periphery of the flame is spaced well apart from the wall of the combustion chamber or the fire box as it is commonly referred to. The valve 138 is then opened.

The vacuum fan 20, such as an in-line fan, for example the type fan employed in hand-held hair driers, such as found in the Schick Hair Drier Model #PD1200, creates a vacuum in the line which causes the ball in the ball valve 136 to deflect upwardly. When the valve 136 opens, a vacuum is created in the chamber 122. This creates a pressure differential between the chamber 122 and the ambient environment about the vapor injector 50. This differential results in the air flowing through the apertures **58*a*, the perforations 116 in the cover 112, the flow passage 110, the water in the flow passage 110, the perforations 106 in the sleeve 104, the water within the sleeve 104 and into the vacuum chamber 122 forming a saturated air stream. This stream flows through conduit 140, valves 136 and 138, conduit 40 and into the main stream of combustion air and finally into the combustion area. When the saturated air stream enters the combustion chamber it mixes with the primary air flow. In adjusting the burner there are two steps. In the first step two variables are initially considered, the flow rate of the saturated air stream, controlled by the valve 138; and the degree of saturation of the air stream at a fixed flow rate which is controlled by the size of the vacuum chamber. Initially the valve 138 is set at mid-point and an efficiency rating of the burner made. This rating which typically involves measuring stack temperature, opacity of the smoke, if any, and carbon dioxide is well known in the art. For example if the burner is "smokey" it would indicate too much moisture in the air stream and the tube 102 would be withdrawn from the plate 94 to enlarge the vacuum chamber 122, lowering the moisture or relative humidity in the air stream. In any event, the size of the vacuum chamber is adjusted until the efficiency rating is maximized. Subsequently in the second step the valve 138** is adjusted until the flame is substantially adjacent but not contacting the walls of the fire box. At this point, the system is calibrated. The entire air requirement may, if desired, come from the secondary source.

If desired, in this second step, the rate of oil flow may be adjusted downwardly and the flow rate of the water vapor increased to maximize efficiency. When the amount of water vapor is too great, the flame will begin to suffocate and accordingly, the flow rate of water vapor is reduced. There are two variables in this second step, the flow rate of the oil and the flow rate of the water vapor, which are adjusted until as described above the flame is adjacent but not touching the walls of the fire box.

Figure 5:
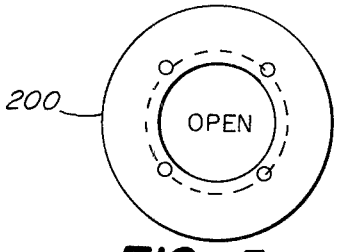
FIG. 5 is a plan view of a baffle.

If desired, the vacuum fan 20 may be eliminated and the conduit 40 secured to the low pressure side of the fan housing 16 such as shown in U.S. Pat. No. 3,862,819. Because the sizes and types of burners vary considerably, to increase the drawing power of such an arrangement by restricting the air passage through the fan housing 16, as shown in FIG. 5, a baffle 200 may be interposed in the normal intake air opening upstream of the fan and downstream of the air intake openings of the assembly 16 substantially perpendicular to the axis of rotation of the fan.

Accordingly, my invention embodies the vapor injector used alone, used in combination with a vacuum fan; or used in combination with some baffling device to limit the normal air intake. The structure which defines the vacuum chamber may assume other geometric configurations, such as square, rectangular, oval, etc. The invention has been described with the tube having inner and outer sleeves to define a flow passage. As will be apparent to those skilled in the art the outer sleeve may be formed as part of the platform and the sleeves may be of different lengths as long as flow passage in combination with the perforations, ensures that the air is drawn through the water and then into the vapor chamber.

Having described my invention, what I now claim is:

1. An apparatus for adding water vapor to a fossil fuel combustion system, which system has an air intake assembly for introducing a flow of air into the combustion area of the combustion system, which comprises:

(a) a housing having a reservoir of water disposed therein;

(b) a platform disposed in the housing and in floating engagement with the reservoir;

(c) a tube-like member secured in a vacuum-tight manner to the platform and extending into the reservoir and having a lower air permeable end and an air impermeable upper end, the inner surface of the member, the closed end and the upper surface of the reservoir defining a vacuum chamber, the dimensions of which remain constant regardless of the level of water in the reservoir, the air permeable lower end being entirely immersed in the water of the reservoir, the tube-like member further comprising an inner sleeve and an outer sleeve, the outer sleeve being air impermeable and the lower end of the inner sleeve being air permeable, the inner and outer sleeves defining a flow passage therebetween, whereby air may flow through the flow passage, the air permeable portion of the inner sleeve through the water and into the vacuum chamber;

(d) valve means to seal the vacuum chamber from the ambient environment, said valve means adapted to open when there is a pressure differential between the vacuum chamber and the ambient environment;

(e) means to draw an air stream through the water and into the vacuum chamber to form a saturated air stream;

(f) a conduit secured to the valve means and the fossil fuel combustion system; and, (g) means to create a pressure differential between the ambient about the housing and the vacuum chamber to draw air through the water and into the vacuum chamber forming the saturated air stream which air stream flows through the valve and into the air intake assembly.

2. The apparatus of claim 1, which includes:

means to control the level of water in the reservoir.

3. The apparatus of claim 1, which includes:

a lid member to enclose the housing, said member removably secured to the housing above the platform, the valve means secured to the lid member;

a flexible conduit secured to the platform and in combination with the valve means and the vacuum chamber, whereby the platform may move with the water level while the volume of the vapor chamber remains constant.

4. The apparatus of claim 3, which includes:

means to control the water level in the reservoir.

5. The apparatus of claim 1, wherein the means to create a pressure differential includes:

means to create a vacuum secured to the air intake assembly.

6. The apparatus of claim 5, wherein the means to create a vacuum includes:

a vacuum pump secured to the air intake assembly and adapted to provide a secondary air stream, and wherein the conduit is secured to the low pressure side of the vacuum pump.

7. The apparatus of claim 5, wherein the means to create a pressure differential includes:

means to baffle the airflow flowing through the air intake assembly to increase the pressure differential between the vacuum chamber and the ambient environment.

8. The apparatus of claim 5 wherein the means to draw the air through the water includes means to form a flow passage between the ambient and the lower end of the tube.

9. The apparatus of claim 1 wherein the inner and outer sleeves are formed integrally with a cover, the cover secured in a vacuum tight manner to the platform, the portion of the cover disposed between the upper edges of the inner and outer sleeves including at least one perforation for the flow of air therethrough; the lower end of the inner sleeve including a plurality of perforations disposed such that the flow of air through the lower portion of the inner sleeve and into the vacuum chamber will be substantially uniform.

10. The apparatus of claim 1 which includes:

means to vary the spatial relationship between the tube-like member and the platform to control the size of the vacuum chamber.

11. The apparatus of claim 10 wherein the means to vary the spatial relationship includes a plurality of threads on the outer surface of the tube and the platform includes an aperture having an internally threaded surface to threadily engage the tube-like member.

12. The apparatus of claim 10 wherein the tube-like member is slidably received in the platform and the upper edge of the tube-like member includes an outwardly extending lip and a collar is disposed between the upper surface of the platform and the lip.

13. A method of metering controlled amounts of water vapor into the combustion area of a combustion system, which system has an air intake assembly for introducing a stream of air into the combustion area, which includes:

placing a reservoir of water in communication with the air intake assembly;

forming a vacuum chamber above the reservoir;

maintaining the volume of the vacuum chamber constant regardless of the level of water in the reservoir;

flowing uniformly an air stream through a plurality of perforations, said perforations being immersed in the water in the reservoir and into the vacuum chamber to form a saturated air stream having uniformly dispersed water droplets; and, introducing the saturated air stream into the combustion system.

14. The method of claim 13 which includes:

creating a vacuum in the vacuum chamber to effect the movement of the air stream through the reservoir and into the vacuum chamber.

15. The method of claim 13 wherein the air flow created by the air intake assembly is a primary air stream and which includes:

providing a secondary air stream and further wherein said secondary air stream is the saturated air stream.

* * * * *